US006053381A

United States Patent [19]

Fahl et al.

[11] Patent Number: 6,053,381

[45] Date of Patent: Apr. 25, 2000

[54] RETRACTABLE SHOULDER STRAP BACKPACK

[76] Inventors: Scott R. Fahl, Avebury Ct.; Christopher C. Vande Zande, 538 North St., both of Nekoosa, Wis. 54457

[21] Appl. No.: 09/104,399

[22] Filed: Jun. 25, 1998

Related U.S. Application Data

[60] Provisional application No. 60/061,993, Oct. 14, 1997.

[51] Int. Cl.[7] ..... A45F 4/02

[52] U.S. Cl. ..... 224/153; 150/108; 224/162; 224/578

[58] Field of Search ..... 224/153, 162, 224/577, 578, 250, 259, 257, 580, 678; 190/115, 39; 150/108

[56] References Cited

U.S. PATENT DOCUMENTS 3,198,300 8/1965 Tuttle .
3,357,613 12/1967 Chase .
3,995,802 12/1976 Johnston ..... 224/580
4,658,999 4/1987 Hilty .
4,887,751 12/1989 Lehman .
4,961,522 10/1990 Weber .
5,072,867 12/1991 Zingale ..... 224/162
5,114,059 5/1992 Thatcher .
5,294,029 3/1994 Shimura et al. ..... 224/162
5,341,973 8/1994 Dawes et al. .
5,529,229 6/1996 Fier .

*Primary Examiner*—Allan N. Shoap
*Assistant Examiner*—Maerena W. Brevard
*Attorney, Agent, or Firm*—Richard C. Litman

[57] ABSTRACT

A backpack with at least one strap that can quickly be retracted or extended to permit the user to easily put on or remove the backpack. The backpack includes a retracting mechanism and a locking device. The retracting mechanism allows the retracting strap to extend or retract as desired. The locking device keeps the strap from extending or retracting while the backpack is being carried.

7 Claims, 4 Drawing Sheets

RETRACTABLE SHOULDER STRAP BACKPACK

CROSS-REFERENCE TO RELATED APPLICATION

This application claims the benefit of U.S. Provisional Patent Application Ser. No. 60/061,993, filed Oct. 14, 1997.

BACKGROUND OF THE INVENTION

1. Field of the Invention

The present invention relates to luggage with a retractable shoulder strap and more particularly, to a backpack with at least two straps, one of which is a retracting strap. The retracting strap is quickly retracted or extended to permit the user to easily put on or remove the backpack.

2. Description of Related Art

Various luggage devices with straps that can be manually adjusted have been developed in the past. For backpacks, the straps are generally adjustable to fit various sizes of users. Typical backpack straps take some time to adjust, so once adjusted to a particular user, the straps are generally left in one position. The straps are fixed in position during carrying of the backpack and also when the backpack is put on or removed from the user's back. The result is that although it is relatively easy to position one arm through the first strap, it often is a struggle to place the remaining arm through the second strap. The struggle is even greater when the load of the backpack is heavy. Backpacks with suitable straps that can be quickly extended or retracted in length to more easily enable the backpack to be put on or removed from the user's back were not uncovered.

Retractable car seat belts are known which extend while the user is putting on the belt, retract to fit around the user, and lock in place when required. These belts are not designed for use with backpacks.

Accordingly, a need will be seen for a backpack with at least one quick-release strap that would enable the user to release a mechanism so that the strap will easily extend or retract. In addition, there is a need for a device as described above that is easily and economically produced. Related patents are described below.

U.S. Pat. No. 3,198,300 issued to Tuttle on Aug. 3, 1965 describes a retractable strap on a bag for a bowling ball. The device has one strap that rests on the user's shoulder. The strap is wound around at least one spool or pulley which is spring rotated so that the strap may be automatically coiled back on the spool once the weight of the article is no longer supported by the strap. Such a device automatically retracts most of the length of the strap when the bowling ball is removed from the bag.

U.S. Pat. No. 4,658,999 issued to Hilty on Apr. 21, 1987 describes a ski carrier device that has a single strap that is attached to a coiling device to give tension for the strap that is placed between an arm and a shoulder of the user. The length of the strap cannot be selectively sized to suit the user and the device is not customized for backpack use.

U.S. Pat. No. 3,357,613 issued to Chase on Dec. 12, 1967 describes a restraint harness which includes a pair of load support retractors. This device is customized for carrying loads that are well secured onto the user. The device is not designed for use in backpacks where getting into and out of the backpack straps is critically important.

U.S. Pat. No. 4,887,751 issued to Lehman on Dec. 19, 1989 describes a traveler's luggage with a retractable and extendable strap to be secured around the upper torso, below an armpit of the user. The device includes a retractor belt mechanism with pulleys. This device only has one strap and hence, for heavy loads, the weight of the load rests on the single strap, making the carrying of heavy loads uncomfortable. The retractable strap when released permits the removal of the luggage. The device does not easily allow the quick release of the luggage from the user as in the present invention.

U.S. Pat. No. 5,294,029 issued to Shimura on Mar. 15, 1994 describes a retractable strap device on a bag that includes a mechanism for allowing the strap to be withdrawn or extracted to a desired length and a locking mechanism for controlling the movements of the strap. The device has one strap that rests on the user's shoulder. The device is not designed for use in backpacks where getting into and out of the backpack straps is critically important.

U.S. Pat. No. 5,529,229 issued to Fier on Jun. 25, 1996 describes a backpack/fanny-pack with Y-shaped shoulder straps that can be drawn out and attached to the rear side portions of the waist encircling belt that provides additional support for the pack. The retraction of the shoulder straps cannot be customized for either the left or right shoulder, but simultaneously for both. Hence this device cannot be easily released by pulling on a single shoulder strap.

None of the above noted inventions and patents, taken either singly or in combination, is seen to describe the instant invention as claimed.

SUMMARY OF THE INVENTION

By the present invention a backpack is disclosed with at least one strap that can quickly be retracted or extended to permit the user to easily put on or remove the backpack. The backpack includes a retracting mechanism and a locking device. The retracting mechanism allows the retracting strap to extend or retract as desired. The locking device keeps the strap from extending or retracting while the backpack is being carried.

Accordingly, it is a principal object of the present invention to provide a backpack with at least one retractable shoulder strap, the length of which can be instantly extended or retracted for putting on and removing the backpack.

Another object of the present invention is to provide a backpack which is comfortable, easy to carry, and easily put on and removed from the user's back, even when the backpack load is heavy.

Another of the objects of the present invention is to provide a backpack having a locking device which fixes the length of a retractable shoulder strap at a desired position for carrying and can maintain that length under a continuous load while the backpack is being carried.

Another object of the present invention is to provide a backpack having straps which can be separately adjusted for the user's left and right shoulders and which can be adjusted for any size user.

Still another object of the present invention is to provide a backpack with an instantly retractable shoulder strap that can carry heavy loads, is durable, and is economical to produce.

These and other objects of the present invention will be more readily apparent as the nature of the invention is hereinafter more fully described, illustrated and claimed with reference being made to the attached drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

Figure 1:
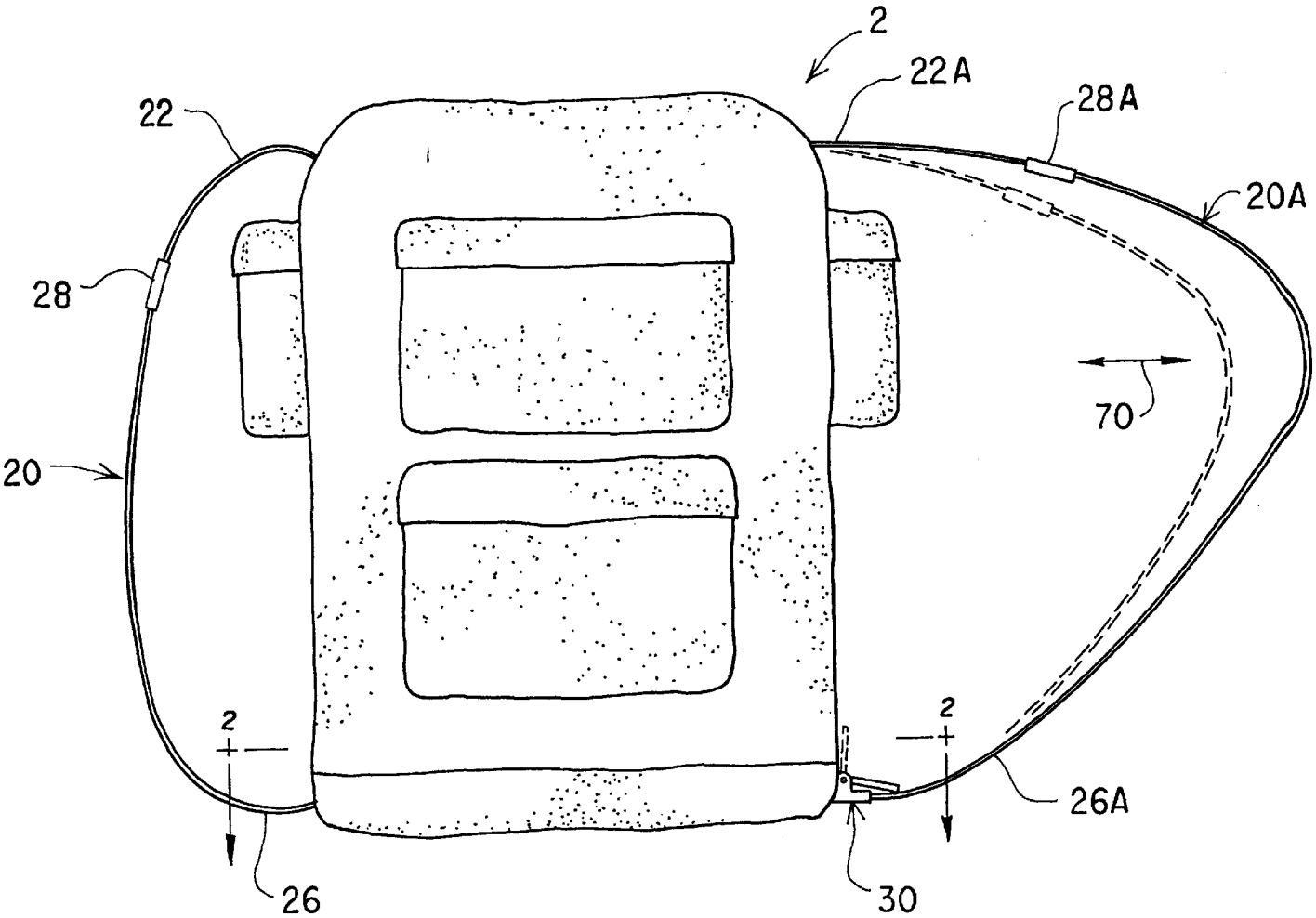
FIG. 1 is a front elevational view of a backpack with a shoulder strap that can quickly be retracted or extended.

The present invention is a backpack with at least one retractable strap that can quickly be retracted or extended to permit the user to easily put on or remove the backpack. The device includes a retracting mechanism and locking device. The retracting mechanism permits the user to pull on a strap to quickly extend the length of the strap and retracts the strap when released. The locking device fixes the length of the strap for carrying.

Embodiments of the various aspects of the present invention will now be explained with reference to the accompanying drawings. By way of illustration and not limitation, FIGS. 1 to 6 are presented to show the preferred embodiments of the applicant's invention.

The backpack 2 is adapted to be carried on the back of a user. The backpack 2 may have a number of different sizes and designs. The backpack 2 may be a daypack or a pack designed for students carrying books. The backpack 2 may include a frame for more extensive backpacking trips. Lines may be included for use with self-contained breathing apparatus, such as for scuba diving or for use by firemen. The backpack 2 may be a military style with attachments for weapons and the like.

In the preferred embodiment, the backpack 2 includes a main bag having a front section 8 and a rear section 6. The rear section 6 has a first portion and a second portion. Preferably the first portion is the upper portion 10 and the second portion is the lower portion 12. The backpack 2 has at least two straps, including at least one retracting strap 20A. Preferably the backpack 2 includes a non-retracting strap 20. Other straps may be included, such as a waist strap. The non-retracting strap 20 and the retracting strap 20A are attached to the rear section 6 of the backpack 2. The straps 20, 20A are spaced apart so that one strap rests on each shoulder with a space between the straps for the neck of the user.

The retracting strap 20A has a non-retractable end 22A, a retractable end 26A, and a length from the non-retractable end 22A to the retractable end 26A. Preferably the non-retractable end 22A is an adjustable end.

The non-retracting strap 20 preferably has an adjustable end 22, a fixed end 26, and a length from the adjustable end 22 to the fixed end 26. The adjustable end 22 of the non-retracting strap 20 is adjustably attached to the first or upper portion 10 of the rear section 6 of the backpack 2. The length of the non-retracting strap 20 is manually adjustable to an appropriate length for carrying of the backpack 2 by the user by a clip device 28 that is known to those familiar with the art. The fixed end 26 of the non-retracting strap 20 is fixedly attached to the second or lower portion 12 of the rear section 6 of the backpack 2.

The adjustable end 22A of the retracting strap 20A is adjustably attached to the first or upper portion 10 of the rear section 6 of the main bag. The length of the retracting strap 20A manually adjustable to an appropriate length for carrying of the backpack by the user with a second clip device 28A. The retractable end 26A is attached to the second or lower portion 12 of the rear section 6. Both of the adjustable ends 22 and 22A can be separately adjusted for the user's left and right shoulders and can be adjusted for any size user.

The retracting strap 20A includes a retracting means for selectively extending and retracting the length of the retracting strap 20A while the backpack 2 is being put on and removed from the user's back. The retracting means may be housed in the second or lower portion 12 of the rear section 6. The retracting strap 20A also includes a locking means for stopping the retracting means from extending and retracting the length of the retracting strap 20A during carrying of the backpack 2. The second portion 12 of the rear section 6 may include an opening. The retracting strap 20A may extend through the opening, and the locking means may be positioned near the opening.

Figure 2:
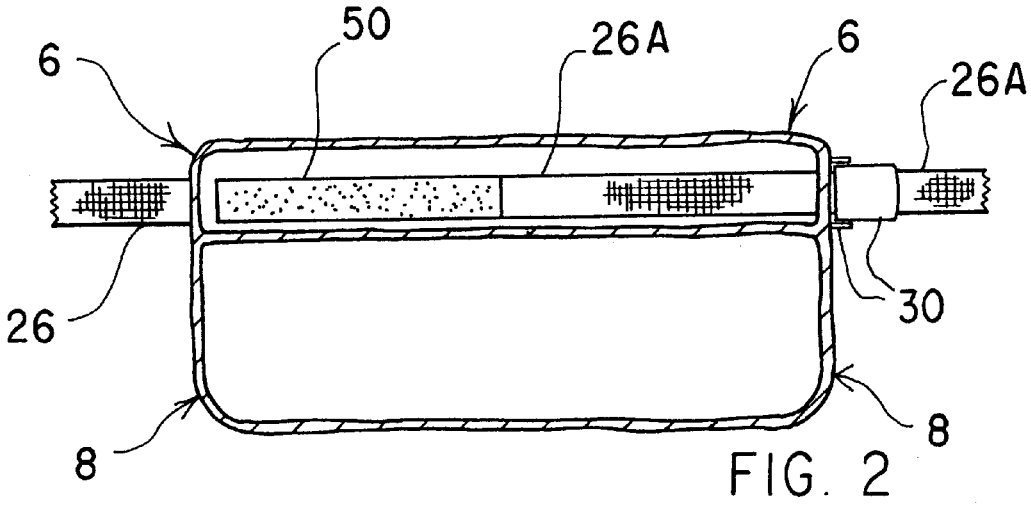
FIG. 2 is a sectional view along line 2—2 of the backpack of FIG. 1 showing an elastic band that can quickly be retracted or extended.
Figure 3:
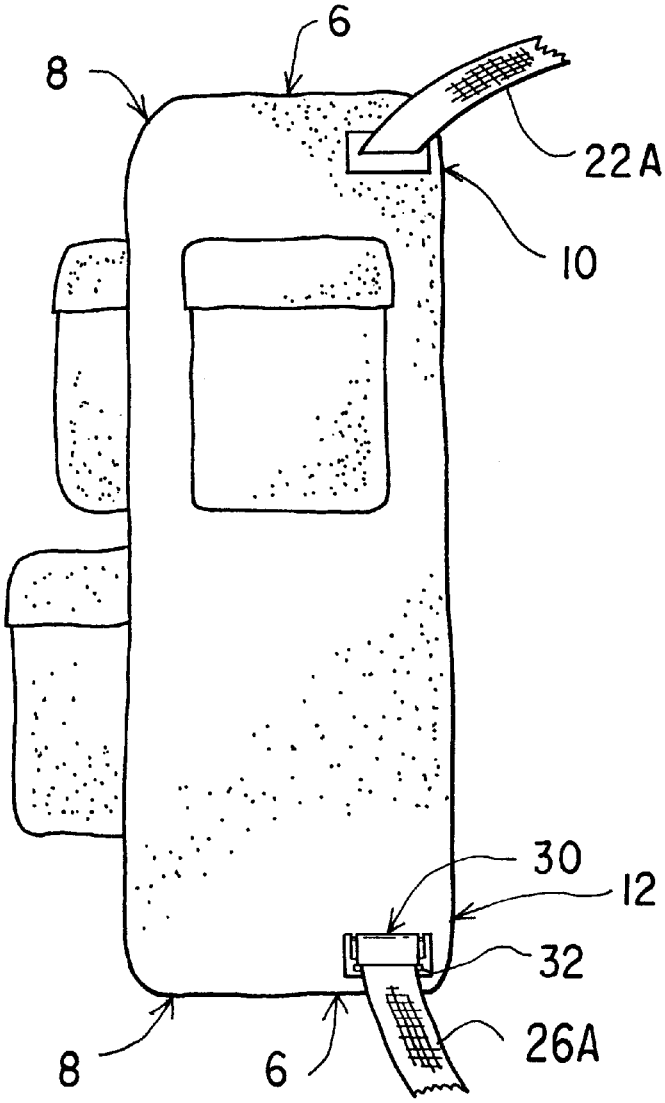
FIG. 3 is a side elevational view of the backpack of FIG. 1.

In one embodiment, as in FIGS. 1–3, the retracting means for the retracting strap 20A is in the form of an elastic band 50. The elastic band 50 has two ends. The band 50 is attached, at one end, to the remainder of the retracting strap 20A. The other end of the band 50 is attached to the lower portion 12 of rear section 6 of the backpack 2. The elastic band 50 stretches to extend and contracts to retract the retracting strap 20A.

The locking means may include a buckle 30 that closes to stop the retracting means from extending and retracting the length of the retracting strap 20A during carrying of the backpack 2. The buckle 30 opens to release the retracting means while the backpack 2 is being put on and removed from the user's back. The buckle 30 is positioned conveniently so that the user can easily access the buckle to release or actuate the buckle 30. The buckle 30 has an opening 32 through which the retracting strap 20A slides.

In the embodiment of FIGS. 1–3, the locking means is a buckle 30 positioned at the base of the backpack 2. By unbuckling the buckle 30 to release the retracting strap 20A, the length of the retracting strap 20A can be lengthened or shortened to a desired length. The retracting strap 20A can be fixed in position (length-wise) by buckling the locking device 30 to lock-in the length of the retracting strap 20A. The elastic properties of the band 50 permits the user to easily adjust the length of the retracting strap 20A to a desired length so that the user can put on or remove the backpack 2 with ease. It is preferred that the elastic band 50 is a bungee cord. The quick-release feature of the retracting strap 20A is particularly helpful to users with backpacks 2 with heavy loads, since this feature enables the user to more easily put on or remove the backpack 2.

Figure 4:
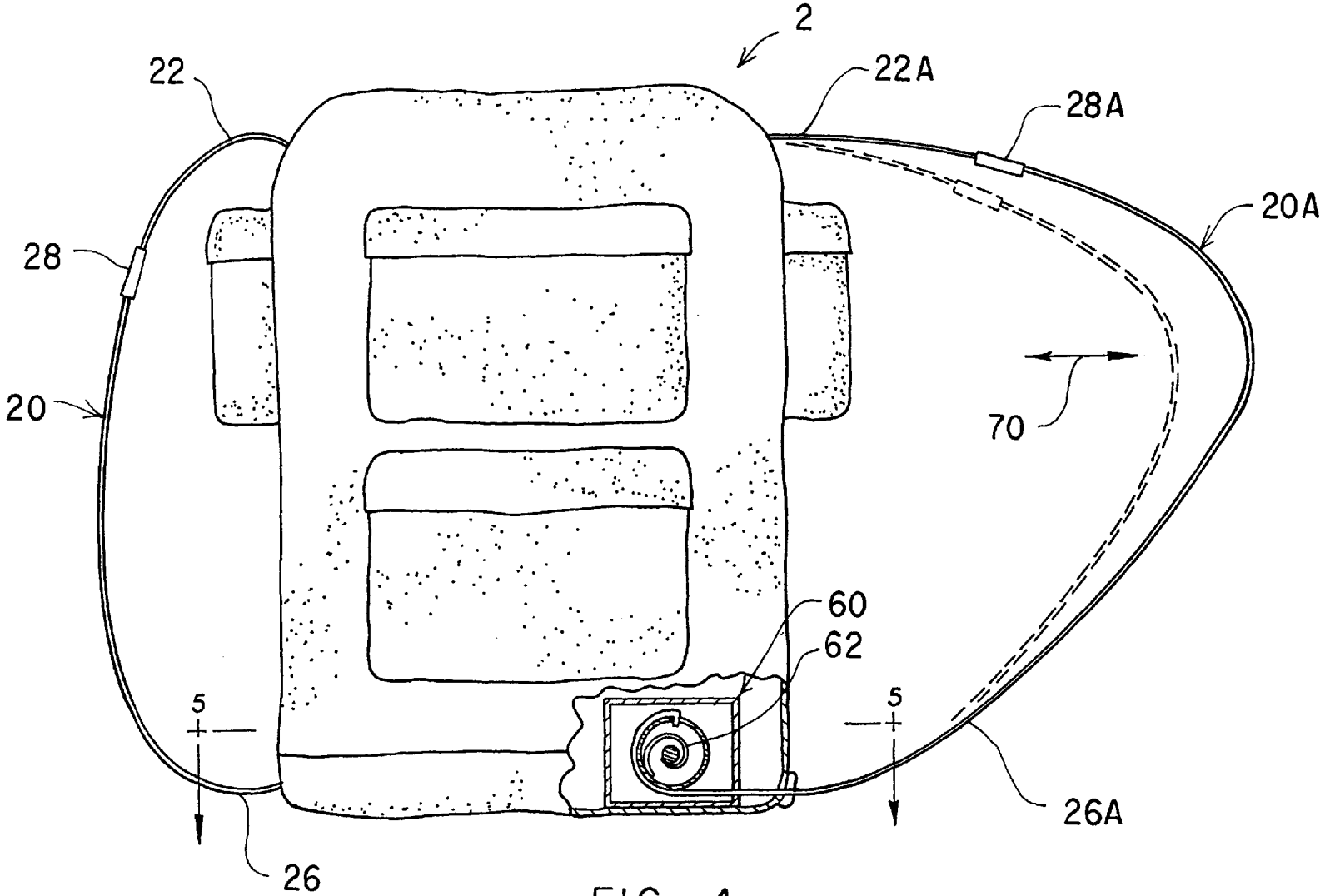
FIG. 4 is a front elevational view of a backpack shown with a cutaway view of a coil mechanism.
Figure 5:
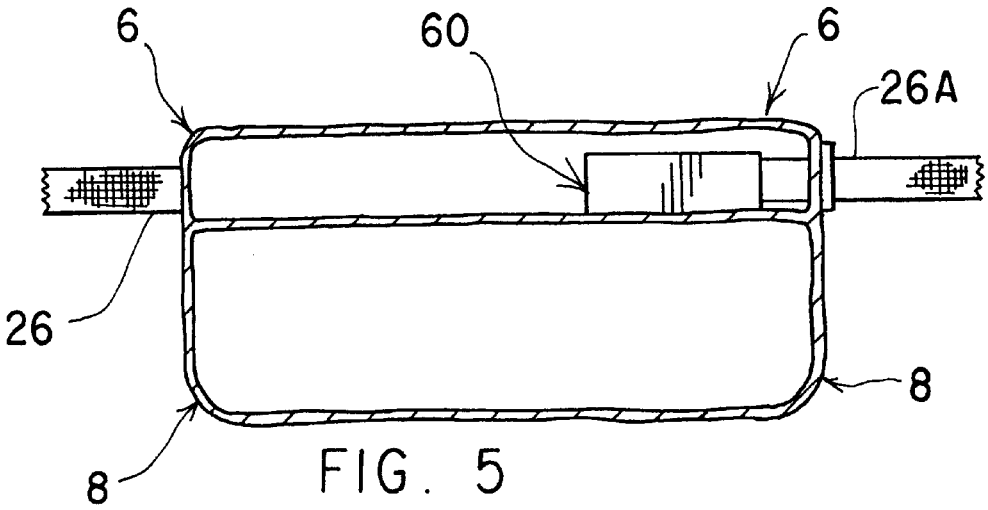
FIG. 5 is a sectional view along line 5—5 of the backpack of FIG. 4, showing the coil mechanism that can quickly be retracted or extended.
Figure 6:
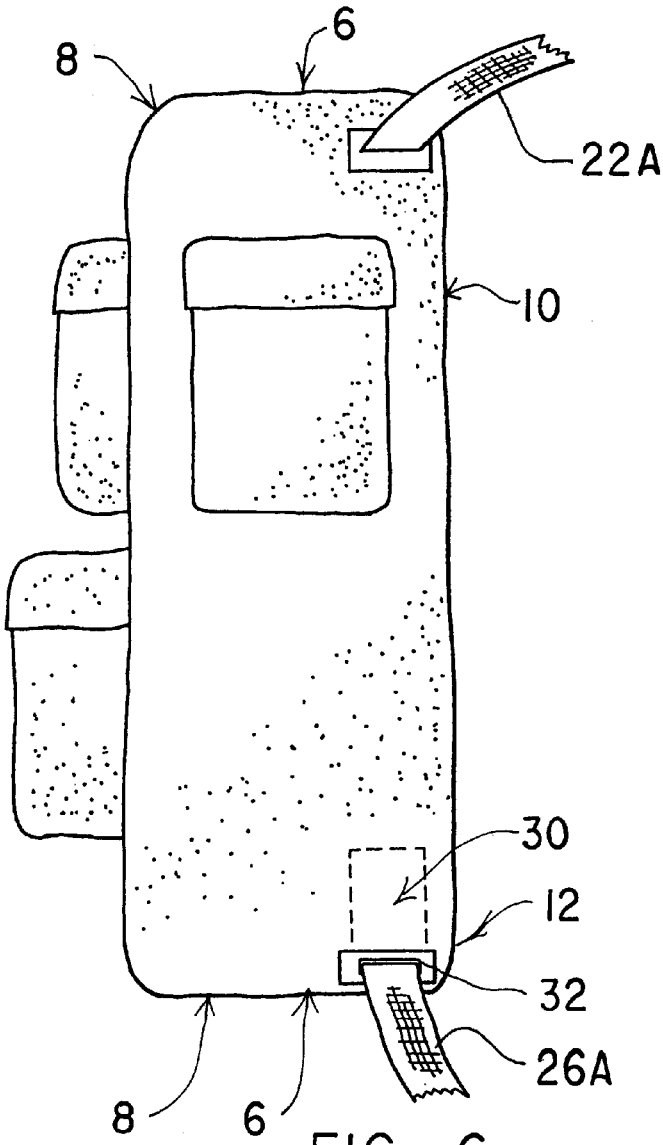
FIG. 6 is a side elevational view of the backpack of FIG. 4.

In FIGS. 4–6, another preferred embodiment of the present invention is shown. In this embodiment, the retracting means for retraction and extension of the retracting strap 20A is a coil spring mechanism 60 that includes a coil spring 62. The outer end of the coil spring 62 is attached to the remainder of the retracting strap 20A. The coil spring mechanism 60 selectively uncoils to extend and recoils to retract the retracting strap 20A to a desired length. When the retracting strap 20A is first gently yanked in a lateral direction 70, the tensioning mechanism in the coil mechanism 60 is released to permit the pulling or retraction of the retracting strap 20A. At a desired length for the retracting strap 20A, the tensioning mechanism in the coil mechanism 60 is self-activated to lock-in the length of the retracting strap 20A. The coil spring mechanism 60 can maintain the length of the retracting strap under a continuous load while the backpack is being carried.

The retracting means, either as described in the form of an elastic band type device or a coil spring type device, can be placed in any convenient position inside the backpack 2 or attached to the backpack 2. For instance, in another embodiment, the coiling mechanism 60 or the elastic band 50 can be placed in the upper portion 10 of the rear section 6 and the recoil mechanism 50, 60 can be attached to the adjustable end 22A of the retracting strap 20A.

It is to be understood that the present invention is not limited to the embodiments described above, but encompasses any and all embodiments within the scope of the following claims.

We claim:

1. A backpack adapted to be carried on a back of a user comprising:

(a) a main bag having a rear section, said rear section having a first portion and a second portion, (b) at least two straps, including a retracting strap having a non-retractable end, a retractable end, and a length from the non-retractable end to the retractable end, the non-retractable end being attached to the first portion of the main bag, the retractable end being attached to the second portion, (c) a retracting means for selectively extending and retracting the length of said retracting strap along a predetermined axis; and (d) a locking means for temporarily fixing position of the length of said retracting strap in response to a change in angle of said length relative to said predetermined axis, wherein, when worn on the back of a user, said locking means locks said retracting strap, said locking means including a buckle adapted and positioned proximate said retracting strap to stop said retracting means from extending and retracting the length of said retracting strap during carrying of the backpack, and to release said retracting means while the backpack is being put on and removed from the user's back.

2. The backpack adapted to be carried on a back of a user as recited in claim 1, wherein the first portion of the rear section is an upper portion and the second portion of the rear section is a lower portion.

3. The backpack adapted to be carried on a back of a user as recited in claim 1, wherein said retracting means is housed in the second portion of the rear section, the second portion of the rear section includes an opening, said retracting strap extends through the opening, and the locking means is positioned near the opening.

4. The backpack adapted to be carried on a back of a user as recited in claim 1, wherein said retracting means includes a coil spring mechanism adapted to uncoil to extend and recoil to retract said retracting strap.

5. A backpack adapted to be carried on a back of a user comprising:

(a) a main bag having a rear section, said rear section having a first portion and a second portion, (b) at least two straps, including a retracting strap having a non-retractable end, a retractable end, and a length from the non-retractable end to the retractable end, the non-retractable end being attached to the first portion of the main bag, the retractable end being attached to the second portion, (c) a retracting means for selectively extending and retracting the length of said retracting strap along a predetermined axis, wherein said retracting means includes an elastic band that stretches to extend and contracts to retract said retracting strap; and (d) a locking means for temporarily fixing position of the length of said retracting strap in response to a change in angle of said length relative to said predetermined axis, wherein, when worn on the back of a user, said locking means locks said retracting strap.

6. The backpack adapted to be carried on a back of a user as recited in claim 5, wherein said elastic band is a bungee cord.

7. A backpack adapted to be carried on a back of a user comprising:

(a) a main bag having a rear section, said rear section having a first portion and a second portion, (b) at least two straps, including a retracting strap and a non-retracting strap, said retracting strap having an adjustable, non-retractable end, a retractable end, and a length from the adjustable non-retractable end to the retractable end, the non-retractable end being attached to the first portion of the main bag, the retractable end being attached to the second portion, said non-retracting strap having an adjustable end, a fixed end, and a length from the adjustable end to the fixed end, the fixed end being fixedly attached to the second portion of the rear section, and the adjustable ends of each of the retracting and non-retracting straps being adjustably attached to the first portion of the rear section so that said retracting and non-retracting straps are manually adjustable to an appropriate length for carrying of the backpack by the user, wherein each of the adjustable ends of said non-retracting and retracting straps is adjustably attached to the first portion of the rear section by a clip;

(c) a retracting means for selectively extending and retracting the length of said retracting strap along a predetermined axis; and (d) a locking means for temporarily fixing position of the length of said retracting strap in response to a change in angle of said length relative to said predetermined axis, wherein, when worn on the back of a user, said locking means locks said retracting strap.

* * * * *